US005793394A

United States Patent [19]

Kato

[11] Patent Number: 5,793,394

[45] Date of Patent: Aug. 11, 1998

[54] INK JET PRINTER HEAD HAVING LESS THERMALLY EXTENDABLE DIAPHRAGM

[75] Inventor: Manabu Kato, Seto, Japan

[73] Assignee: Brother Kogyo Kabushiki Kaisha, Nagoya, Japan

[21] Appl. No.: 595,071

[22] Filed: Feb. 1, 1996

[30] Foreign Application Priority Data

Feb. 13, 1995 [JP] Japan ..... 7-024275

[51] Int. Cl.[6] ..... B41J 2/045

[52] U.S. Cl. ..... 347/70; 347/68

[58] Field of Search ..... 347/68, 70; 310/328

[56] References Cited

U.S. PATENT DOCUMENTS

| | | | |
|---|---|---|---|
| 4,312,007 | 1/1982 | Winfield | 347/14 |
| 4,998,120 | 3/1991 | Koto et al. | 347/70 |
| 5,510,819 | 4/1996 | Fujimoto et al. | 347/70 |
| 5,612,725 | 3/1997 | Okimoto | 347/70 |
| 5,639,508 | 6/1997 | Okawa et al. | 347/68 |

FOREIGN PATENT DOCUMENTS 53-12138 4/1978 Japan .

*Primary Examiner*—Stuart N. Hecker
*Attorney, Agent, or Firm*—Oliff & Berridge, P.L.C.

[57] ABSTRACT

In an ink jet printer head using a hot-melt ink, a diaphragm disposed between a piezoelectric element and a cavity plate is made from such a resin that has more than 400 kg/mm$^2$ modulus of elasticity, less than $20\times10^{-6}$ cm/cm·° C. rate of thermal expansion, and more than 20 kg/mm$^2$ tensile strength. With the use of such a resin material in the diaphragm, the diaphragm stretched over the cavity plate will not be loosened even if there is a temperature change in the diaphragm, whereby ink ejection which is highly responsive to the displacement of the piezoelectric element can be attained.

7 Claims, 3 Drawing Sheets

FIG. 2
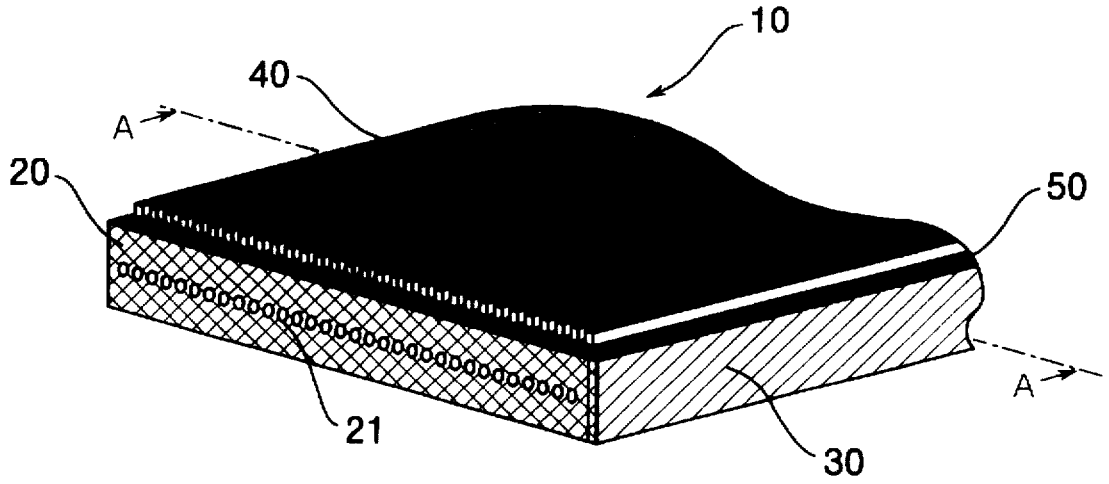
FIG. 3A
FIG. 3B
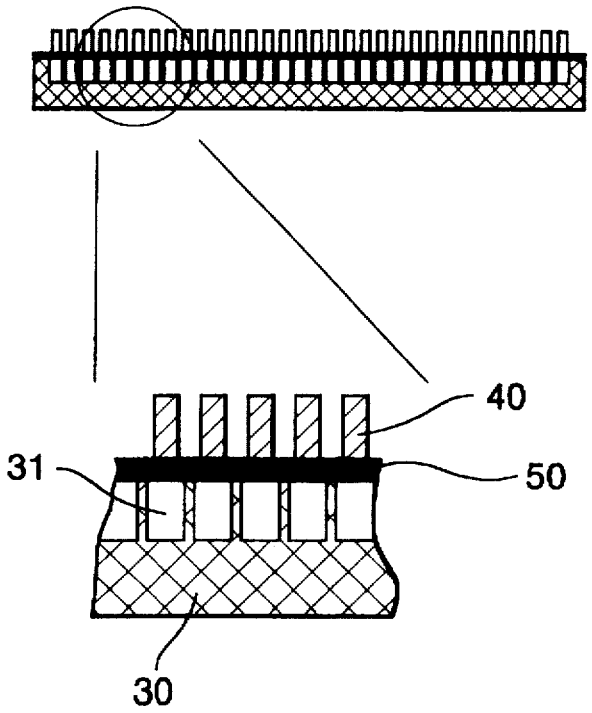

INK JET PRINTER HEAD HAVING LESS THERMALLY EXTENDABLE DIAPHRAGM

BACKGROUND OF THE INVENTION

1. Field of the Invention

The present invention relates to an ink jet printer head, and more particularly to an ink jet printer head of the type wherein ink droplets are ejected in response to pressure exerted through a diaphragm to an ink chamber by a displacement of a piezoelectric element.

2. Description of the Related Art

Recently, ink jet printers are drawing customers' attention in the market because, among other reasons, they are simple in operational principle and can easily accomplish multi-gradation and color printing. Particularly, because of good ink ejection efficiency and inexpensive running cost, the number of drop-on-demand ink jet printers sold in the market is increasing. Unlike printers which continuously eject ink droplets regardless of whether or not they are used for printing, drop-on-demand printers eject only ink droplets that are required for printing.

Japanese Examined Patent Publication (Kokoku) No. 53-12138 discloses a Kyser type drop-on-demand ink jet printer wherein the operation of an electrical-to-mechanical converting element changes a volume in an ink chamber to thereby increase the internal pressure in the ink chamber. Ink droplets are thus ejected from a nozzle which is in fluid communication with the ink chamber.

A recently proposed printer is shown in FIG. 1. As shown, a nozzle plate 84 made of resin is engraved with a plurality of ink channels 83 which are aligned in parallel to one another. A resiliently deformable diaphragm 82 is placed over the nozzle plate 84 to cover the open surface of the ink channels 83. A piezoelectric ceramics 81 having a plurality of leg portions is placed over the diaphragm 82 so that the bottom faces of the leg portions in the piezoelectric ceramics 81 confront the respective ink channels 83 through the diaphragm 82. The leg portions of the piezoelectric ceramics 81 selectively extend to the vertical direction when applied with a voltage so that the ink filled with the ink channels 83 is ejected from the nozzles.

Conventionally, the diaphragms are made from a stainless steel foil or a polyimide (PI) film because it is believed that such materials are effective in defining the ink chamber and transmitting the displacement of the piezoelectric element to the ink chamber without directly touching the piezoelectric element.

However, although it is desirable that the ink jet printers operate constantly and provide a high printing quality regardless of changes in environmental circumstance, stainless steel or PI diaphragms cannot stand changes in ambient environment, such as changes in temperature. Specifically, thermal and/or physical stresses are exerted on the printer head caused by the thermal expansion of the stainless steel or PI diaphragms. Particularly, for ink jet printers using a hot-melt ink, more than 100° C. heating temperature for melting the hot-melt ink exerts thermal stress on the head. Further, because ink can hold more air as the temperature of the ink increases and the diaphragm has a high air permeability, air is introduced into the ink chamber through the diaphragm when the solid-phase hot-melt ink is heated up.

SUMMARY OF THE INVENTION

The present invention has been made to solve the aforementioned problems accompanying conventional ink jet printers, and accordingly it is an object of the invention to provide an ink jet printer whose ink ejection capability is substantially unaffected by temperature increase and which affords a stabilized print quality even under high temperature circumstances, such as high temperatures to melt hot-melt ink.

To achieve the above and other objects, the present invention provides an ink jet printer head which includes an ink nozzle, an ink chamber normally filled with an ink and in fluid communication with the ink nozzle, a piezoelectric element which displaces when applied with a voltage, and a diaphragm disposed between the ink chamber and the piezoelectric element. The diaphragm is resiliently deformable toward the ink chamber in accordance with a displacement of the piezoelectric element to apply a pressure to the ink in the ink chamber, thereby causing an ink droplet to be ejected from the ink nozzle. The diaphragm is made from a resin having more than 400 $kg/mm^2$ modulus of elasticity and less than $20\times10^{-6}$ cm/cm·° C. rate of thermal expansion.

It is preferable that the diaphragm is also made from a resin having less than 1,000 $cc\cdot\mu/m^2\cdot day\cdot atm$ in oxygen permeability. The ink to be used in the printer is a solid-phase in room temperature and is melted to be in liquid-phase when heated. A preferable material for the diaphragm is aromatic polyamide and nylon.

In accordance with another aspect of the invention, there is provided an ink jet printer head using a hot-melt ink which is a solid-phase in room temperature and a liquid-phase when heated. The head also includes an ink nozzle, an ink chamber plate, a piezoelectric element which displaces when applied with a voltage, and a diaphragm disposed between the ink chamber plate and the piezoelectric element, wherein the diaphragm and the ink chamber plate define an ink chamber filled with liquid-phase ink when the head is in operation and in fluid communication with the ink nozzle. The diaphragm is resiliently deformable toward the ink chamber plate in accordance with a displacement of the piezoelectric element to apply a pressure to the liquid-phase ink in the ink chamber, thereby causing an ink droplet to be ejected from the ink nozzle. The diaphragm is made from a resin having more than 400 $kg/mm^2$ modulus of elasticity, less than $20\times10^{-6}$ cm/cm·° C. rate of thermal expansion, more than 20 $kg/mm^2$ tensile strength, and less than 1,000 $cc\cdot\mu/m^2\cdot day\cdot atm$ oxygen permeability.

In further accordance with still another aspect of the invention, there is provided an ink jet printer head using a hot-melt ink which is a solid-phase in room temperature and a liquid-phase when heated. The head includes a plurality of ink nozzles, an ink chamber plate formed with a plurality of ink channels corresponding to the plurality of ink nozzles, a piezoelectric block having a plurality of leg portions, each of the leg portions being displaced when applied with a voltage, and a diaphragm disposed between the ink chamber plate and the piezoelectric block. The diaphragm and the ink chamber plate define a plurality of ink chambers each filled with liquid-phase ink when the head is in operation and in fluid communication with respective ones of the plurality of ink nozzles. The diaphragm is resiliently deformable toward the ink chamber plate in accordance with a displacement of each of the plurality of leg portions of the piezoelectric block to apply a pressure to the liquid-phase ink in a corresponding ink chamber, thereby causing an ink droplet to be ejected from a corresponding ink nozzle. The diaphragm is made from a resin having more than 400 $kg/mm^2$ modulus of elasticity and less than $20\times10^{-6}$cm/cm·° C. rate of thermal expansion, more than 20 $kg/mm^2$ tensile strength.

BRIEF DESCRIPTION OF THE DRAWINGS

The particular features and advantages of the invention as well as other objects will become more apparent from the following description taken in connection with the accompanying drawings, in which:

FIG. 2 is a perspective view showing an ink jet printer head according to an embodiment of the present invention;

FIG. 3A is a cross-sectional view cut along a ling A—A in FIG. 2;

FIG. 3B is an enlarged view of an encircled portion in FIG. 3A; and

DETAILED DESCRIPTION OF THE PREFERRED EMBODIMENTS

A preferred embodiment of the present invention will be described with reference to the accompanying drawings.

Figure 1:
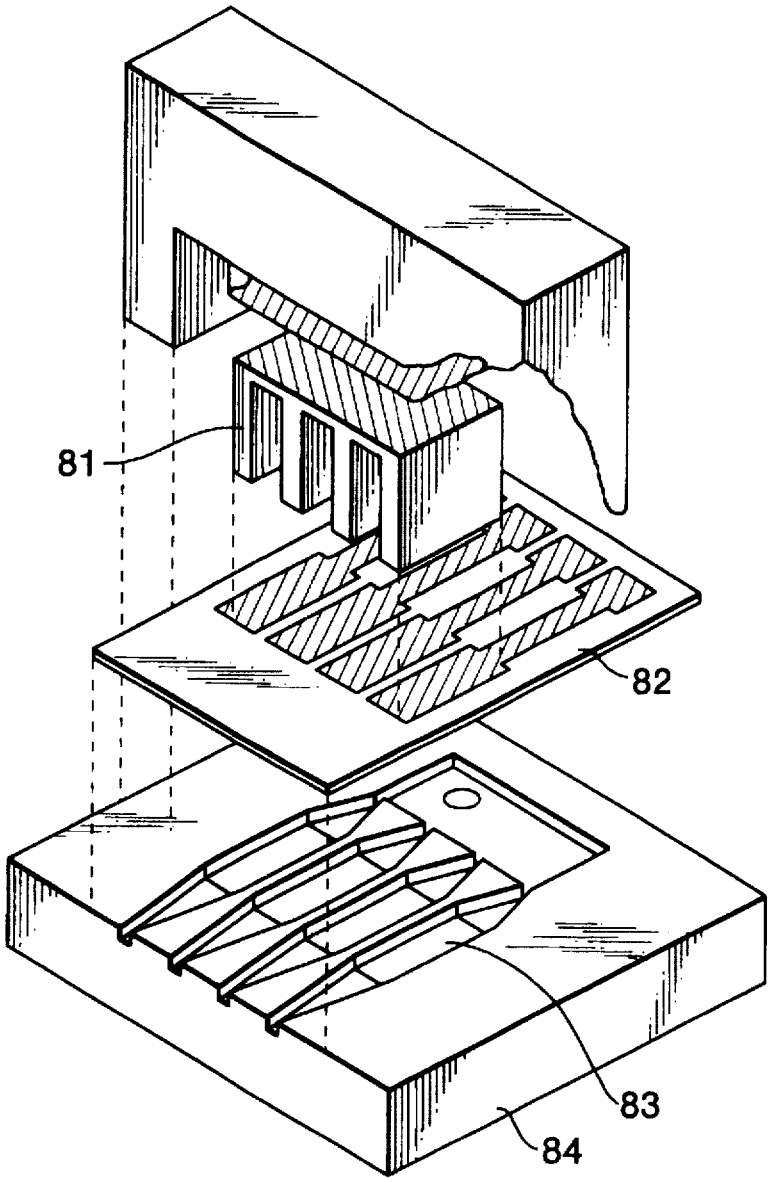
FIG. 1 PRIOR ART
FIG. 1 is a perspective view showing a conventional ink jet printer head.
Figure 4:
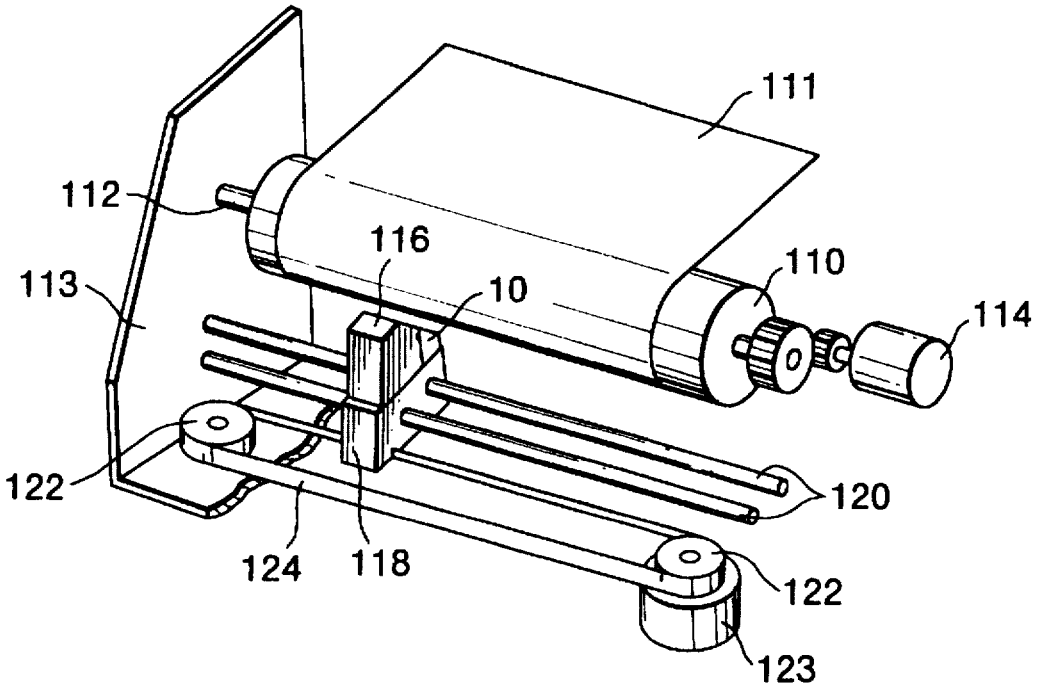
FIG. 4 is a perspective view showing a positional relationship between the ink jet printer head and other components of the printer.

FIG. 4 shows an essential structure of an ink jet printer according to the preferred embodiment. The printer includes a platen 110 with a shaft 112 which is rotatably supported on a frame 113. The platen 110 is rotated by a motor 114. An ink jet printer head 10 is disposed in confrontation with the platen 110 on which a print paper 111 is supported. The head 10 is mounted on a carriage 118 together with an ink supply unit 116. The carriage 118 is slidably movably supported on a pair of rods 120 extending in parallel with the shaft 112 of the platen 110. The carriage 118 is fixedly connected to a timing belt 124 stretched between a pair of spaced apart pulleys 122. A counterpart pulley 122 is rotated by a reversible motor 123, thereby moving the timing belt 124 back and forth. The carriage 118 is thus transported back and forth along the platen 110.

FIG. 2 shows the head 10 of the ink jet printer of the embodiment of the invention and FIGS. 3A and 3B show cross-sectional views cut along a line A—A in FIG. 2. The head 10 includes a nozzle plate 20 having a plurality of nozzles 21 aligned along an imaginary line in parallel with the line A—A. The head 10 is assembled so that the line A—A is in parallel with the axis 112 of the platen 110. The head 10 further includes a cavity plate 30 formed with a plurality of ink channels 31 corresponding to the nozzles 21, and a plurality of piezoelectric elements 40 provided corresponding to the respective ones of the ink channels 31. Each piezoelectric element 40 extends downward when applied with a pulsed voltage. The head 10 further includes a diaphragm 50 intervened between the ink channels 31 and the piezoelectric elements 40. Ink chambers are defined by the diaphragm 50 and the ink channels 31. The diaphragm 50 is flexibly deformed toward the ink chamber when the corresponding piezoelectric element 40 is applied with a pulsed voltage and thus extends toward the ink chamber 31. The nozzle plate 20, the cavity plate 30, diaphragm 50 and the piezoelectric elements 40 are bonded together with an adhesive material.

In the head 10 having a configuration as described above, ink supplied from the ink supply unit 116 is distributed to fill the respective ink chambers. The ink used in the printer is a hot-melt ink that is a wax based ink whose melting temperature is about 70° C. In use, the hot-melt ink is in a liquid-phase heated to about 120° C. To perform printing, a pulsed voltage is applied to the piezoelectric element 40. The piezoelectric element 40 extends toward the ink chamber 31 and causes the diaphragm segment to deform into the ink chamber. As a result, the pressure of the ink in the ink chamber 30 is increased so that an ink droplet is ejected from the nozzle 21 toward the print paper 111.

In the present invention, the material for the diaphragm 50 is selected from a resin that is more than 400 (kg/mm$^2$) in modulus of elasticity, more than 20 (kg/mm$^2$) in tensile strength, less than $20\times10^{-6}$ (cm/cm·° C.) in rate of thermal expansion, and less than 1,000 (cc·μ/10$^2$·day·atm) in oxygen permeability. The most preferable material which meets the above requirements is polyparaphenyleneterephtalamide (PPTA), and PPTA aramid film, generally called "aramica" and produced by Asahi Chemical Industry Co., Ltd. best suits as the material for the diaphragm. Particularly, diaphragms made from aramica are excellent in toughness, oxygen impermeability, dimension stability, and heat resistivity. Nylon, e.g., UBE nylon 1015G09 produced by Ube Industries, Ltd., is also a preferable material for the diaphragm. Diaphragms made from nylon are excellent in toughness, oxygen impermeability and oil resistance.

| | Aramid | Nylon | Polyimide |
|---|---|---|---|
| Tensile Strength (Kg/mm$^2$) | 40 | 20 | 25 |
| Modulus of Elasticity (Kg/mm$^2$) | 1500 | 1200 | 300 |
| Oxygen Permeability (cc · μ/m$^2$ · day · atm) | 18 | 600 | 4200 |
| Rate of Thermal Expansion (cm/cm · °C.) | $2\times10^{-8}$ | $20\times10^{-8}$ | $25\times10^{-8}$ |

The printer head using the hot-melt ink cools to room temperature when the printer is deenergized but heats to a high temperature circumstance when the printer is energized. Also, the head assemblies are subjected to cooling and heating during manufacture of the same. The temperature difference under such circumstances imparts thermal stresses on various parts of the printer head. However, according to the printer head of the present embodiment, the bonding surfaces between the cavity plate 30 and the diaphragm 50 and between the piezoelectric element 40 and the diaphragm 50 are substantially free from thermal stresses because the diaphragm of the present embodiment has a lower thermal expansion rate than the cavity plate 30 and the piezoelectric element 40. Therefore, thermal expansion of the diaphragm 50 is negligibly smaller than that of the cavity plate 30 and the piezoelectric element 40. Such a diaphragm 50 is disposed between the cavity plate 30 and the piezoelectric element 40. Therefore, the diaphragm 50 undergoes substantially no pulling or contraction so that substantially no stress is outstanding in the two bonding surfaces even if the cavity plate 30 and the piezoelectric element 40, which are bonded together with the diaphragm 50 intervened therebetween, are thermally deformed. As a result, the leg portions of the piezoelectric element 40 are prevented from being thermally damaged or cracked. Furthermore, displacement of the piezoelectric element 40 will be sufficiently transferred to the ink chamber because the diaphragm 50 will remain taut even if there is a big temperature difference. Therefore, ink ejection failure which may otherwise occur if the diaphragm 50 is loosened attendant to temperature rise will not occur.

Because of a high modulus of elasticity, the diaphragm according to the present embodiment is highly responsive to the displacement of the piezoelectric element. Further, because of extremely low oxygen permeability of the diaphragm, there is little chance that air or gaseous matter is introduced into the liquid-phase hot-melt ink through the diaphragm despite increases in gas solubility in the ink caused by temperature increases. As a result, generation of bubbles in the ink chamber can be suppressed and thus stabilized ink droplet ejection can be maintained.

What is claimed is:

1. An ink jet printer head comprising:

an ink nozzle;

an ink chamber normally filled with an ink and in fluid communication with said ink nozzle;

a piezoelectric element which displaces when applied with a voltage;

a diaphragm disposed between said ink chamber and said piezoelectric element, said diaphragm being resiliently deformable toward said ink chamber in accordance with a displacement of said piezoelectric element to apply a pressure to the ink in said ink chamber, thereby causing an ink droplet to be ejected from said ink nozzle, wherein said diaphragm is made from a resin having more than 400 $kg/mm^2$ modulus of elasticity and less than $20\times10^{-6}$ cm/cm·° C. rate of thermal expansion.

2. An ink jet printer head according to claim 1, wherein said diaphragm is made from a resin having less than 1,000 $cc\cdot\mu/m^2\cdot day\cdot atm$ in oxygen permeability.

3. An ink jet printer head according to claim 1, wherein said ink is solid-phase in room temperature and is melted to be in liquid-phase when heated.

4. An ink jet printer according to claim 1, wherein said diaphragm is made from an aramatic polyamide.

5. An ink jet printer head according to claim 1, wherein said diaphragm is made from a nylon.

6. An ink jet printer head using a hot-melt ink which is a solid-phase in room temperature and in a liquid-phase when heated, said head comprising:

an ink nozzle;

an ink chamber plate;

a piezoelectric element which displaces when applied with a voltage;

a diaphragm disposed between said ink chamber plate and said piezoelectric element, said diaphragm and said ink chamber plate defining an ink chamber filled with liquid-phase ink when said head is in operation and in fluid communication with said ink nozzle, said diaphragm being resiliently deformable toward said ink chamber plate in accordance with a displacement of said piezoelectric element to apply a pressure to the liquid-phase ink in said ink chamber, thereby causing an ink droplet to be ejected from said ink nozzle, wherein said diaphragm is made from a resin having more than 400 $kg/mm^2$ modulus of elasticity, less than $20\times10^{-6}$ cm/cm·° C. rate of thermal expansion, more than 20 $kg/mm^2$ tensile strength, and less than 1,000 $cc\cdot\mu/m^2\cdot day\cdot atm$ oxygen permeability.

7. An ink jet printer head using a hot-melt ink which is a solid-phase in room temperature and in liquid-phase when heated, said head comprising:

a plurality of ink nozzles;

an ink chamber plate formed with a plurality of ink channels corresponding to said plurality of ink nozzles;

a piezoelectric block having a plurality of leg portions, each of said leg portions being displaced when applied with a voltage;

a diaphragm disposed between said ink chamber plate and said piezoelectric block, said diaphragm and said ink chamber plate defining a plurality of ink chambers each filled with liquid-phase ink when said head is in operation and in fluid communication with respective ones of said plurality of ink nozzles, said diaphragm being resiliently deformable toward said ink chamber plate in accordance with a displacement of each of said plurality of leg portions of said piezoelectric block to apply a pressure to the liquid-phase ink in a corresponding ink chamber, thereby causing an ink droplet to be ejected from a corresponding ink nozzle, wherein said diaphragm is made from a resin having more than 400 $kg/mm^2$ modulus of elasticity and less than $20\times10^{-6}$cm/cm·√ C. rate of thermal expansion, more than 20 $kg/mm^2$ tensile strength.

* * * * *